United States Patent [19]

Yoshieda et al.

[11] Patent Number: 4,459,884

[45] Date of Patent: Jul. 17, 1984

[54] METHOD OF AND APPARATUS FOR PROCESSING A PAIR OF SLIDE FASTENER STRINGERS

[75] Inventors: Keiichi Yoshieda, Kurobe; Toyoo Morita, Uozu, both of Japan

[73] Assignee: Yoshida Kogyo K. K., Tokyo, Japan

[21] Appl. No.: 448,209

[22] Filed: Dec. 9, 1982

[30] Foreign Application Priority Data

Dec. 29, 1981 [JP] Japan ..... 56-215848

[51] Int. Cl.[3] ..... B26D 5/28

[52] U.S. Cl. ..... 83/42; 83/210; 83/251; 83/364; 83/371; 83/921

[58] Field of Search ..... 83/42, 210, 211, 212, 83/251, 364, 371, 921

[56] References Cited

U.S. PATENT DOCUMENTS 2,754,908 7/1956 Proud ..... 83/210 X 4,043,232 8/1977 Jovin ..... 83/921 X 4,250,781 2/1981 Nakamura ..... 83/210

*Primary Examiner*—James M. Meister

[57] ABSTRACT

In a method of and an apparatus for processing a pair of continuous slide fastener stringers having element-free spaces between a plurality of longitudinally spaced chains of partly interengaged coupling elements with sliders mounted respectively thereon, the stringers are fed downwardly in a vertical direction at a low speed by an upper roller feed unit until their leading ends are sensed, whereupon they are fed at a high speed by a lower roller feed unit. The coupling element chains are fully closed one by one by the respective sliders which are releasably held by a slider holder disposed between the feed units while the stringers are fed at the high speed. The stringers are stopped by a chain stopper having means insertable in the element-free space in response to the full closure of the coupling element chain, and are severed across the element-free spaces by a cutter disposed between the slider holder and the lower roller feed unit, the severed chains being automatically neatly stacked on a chute in juxtaposition to each other.

16 Claims, 3 Drawing Figures

METHOD OF AND APPARATUS FOR PROCESSING A PAIR OF SLIDE FASTENER STRINGERS

BACKGROUND OF THE INVENTION

1. Field of the Invention

The present invention relates to a method of and apparatus for automatically closing a slide fastener chain, then severing the closed slide fastener stringers at an element-free space, and then neatly stacking the severed chains in juxtaposition.

2. Prior Art

In a prior apparatus shown in U.S. Pat. No. 4,250,781, issued on Feb. 17, 1981, a pair of continuous slide fastener stringers is fed longitudinally over a horizontal guide table by a grip which is located adjacent to one end of the guide table and is reciprocably movable toward and away from the guide table for a distance corresponding to the length of individual coupling element chains to be severed from the slide fastener stringers. A slider holder is mounted on the other end of the guide table for closing coupling element chains as the slide fastener stringers are fed. The apparatus having such reciprocating grip is relatively large and complicated in construction and is difficult to operate reliably at a relatively high speed. The individual coupling element chains discharged from the horizontal guide table are likely to become disposed at random with the result that inspection and packaging of the severed chains is difficult to achieve.

SUMMARY OF THE INVENTION

A pair of continuous slide fastener stringers, including a plurality of longitudinally spaced chains of partly interengaged coupling elements with a plurality of sliders mounted respectively thereon, is fed downwardly in a vertical direction selectively at a low and at a high speed by a pair of spaced upper and lower roller feed units. Upon the sensing of the leading ends, the slide fastener stringers, which have been fed at the low speed by the upper roller feed unit, are fed at the high speed by the lower roller feed unit. During that time, each of the coupling element chains is fully closed by a corresponding one of the sliders which is releasably held by a slider holder disposed between the upper and lower roller feed units. In response to the full closure of the chain, the slide fastener stringers are stopped by a chain stopper having means insertable in an element-free space between the just closed chain and the following chain. Upon stoppage, the slide fastener stringers are severed across the element free space by a cutter disposed between the slider holder and the lower roller feed unit.

It is an object of the present invention to provide a method of processing a pair of slide fastener stringers at a relatively high speed by closing, severing and preferably neatly stacking the fastener stringers.

Another object of the present invention is to provide an apparatus for reducing such method into practice, which apparatus is relatively small and simple in construction.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION

Figure 1:
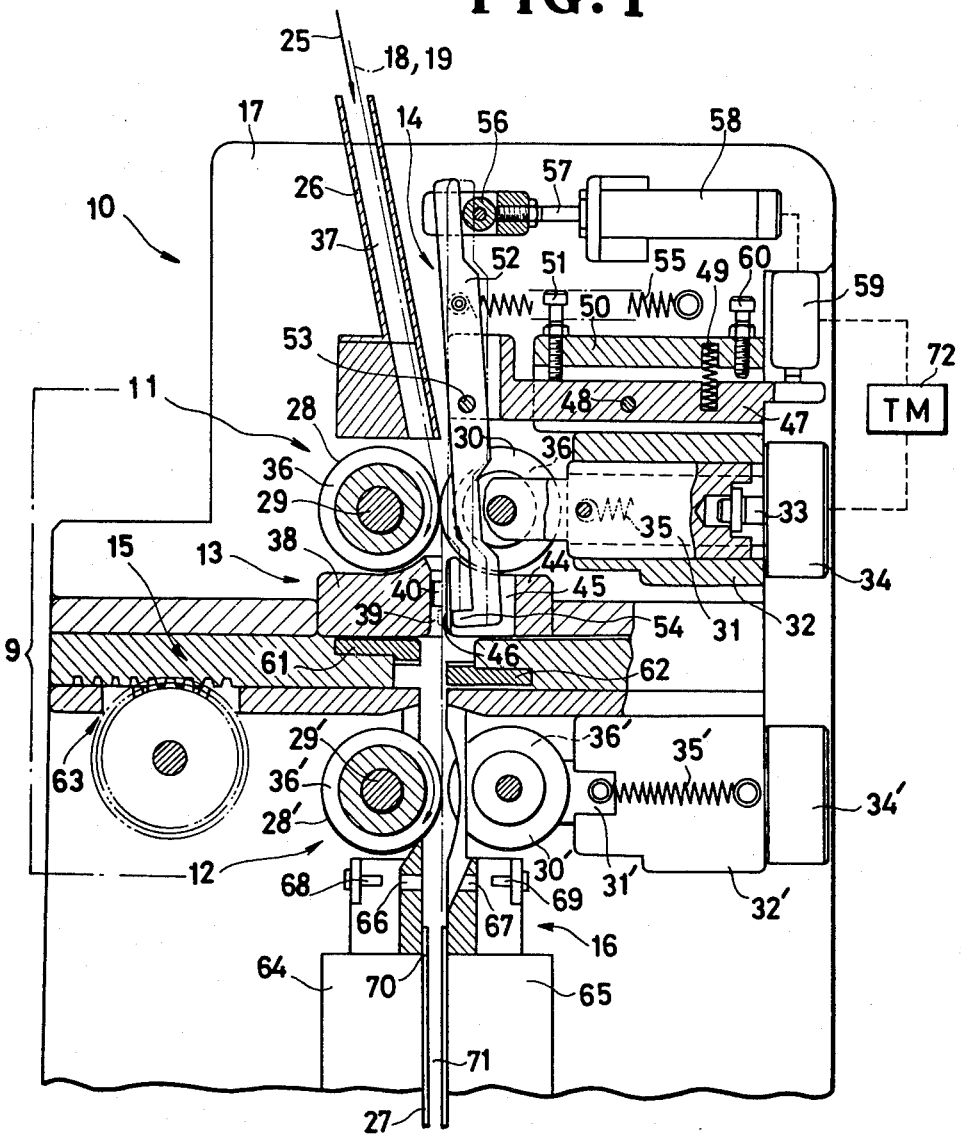
FIG. 1 is a schematic fragmentary front elevational view, partly in cross section, of an apparatus according to the present invention.

The principles of the present invention are particularly useful when embodied in a processing apparatus such as shown in FIG. 1 generally indicated by the numeral 10.

The apparatus 10 generally comprises a feed mechanism 9 including a pair of spaced upper and lower feed units 11, 12, a slider holder 13 disposed between the feed units 11, 12, a chain stopper or stopping mechanism 14 disposed above the upper feed unit 11 remotely from the slider holder 13, a cutter 15 disposed between the slide holder 13 and the lower feed unit 12, and an end sensor 16 disposed below the lower feed unit 12 remotely from the cutter 15, all the parts 11–16 being mounted on a vertical base 17 substantially in vertical alignment with one another.

Figure 2:
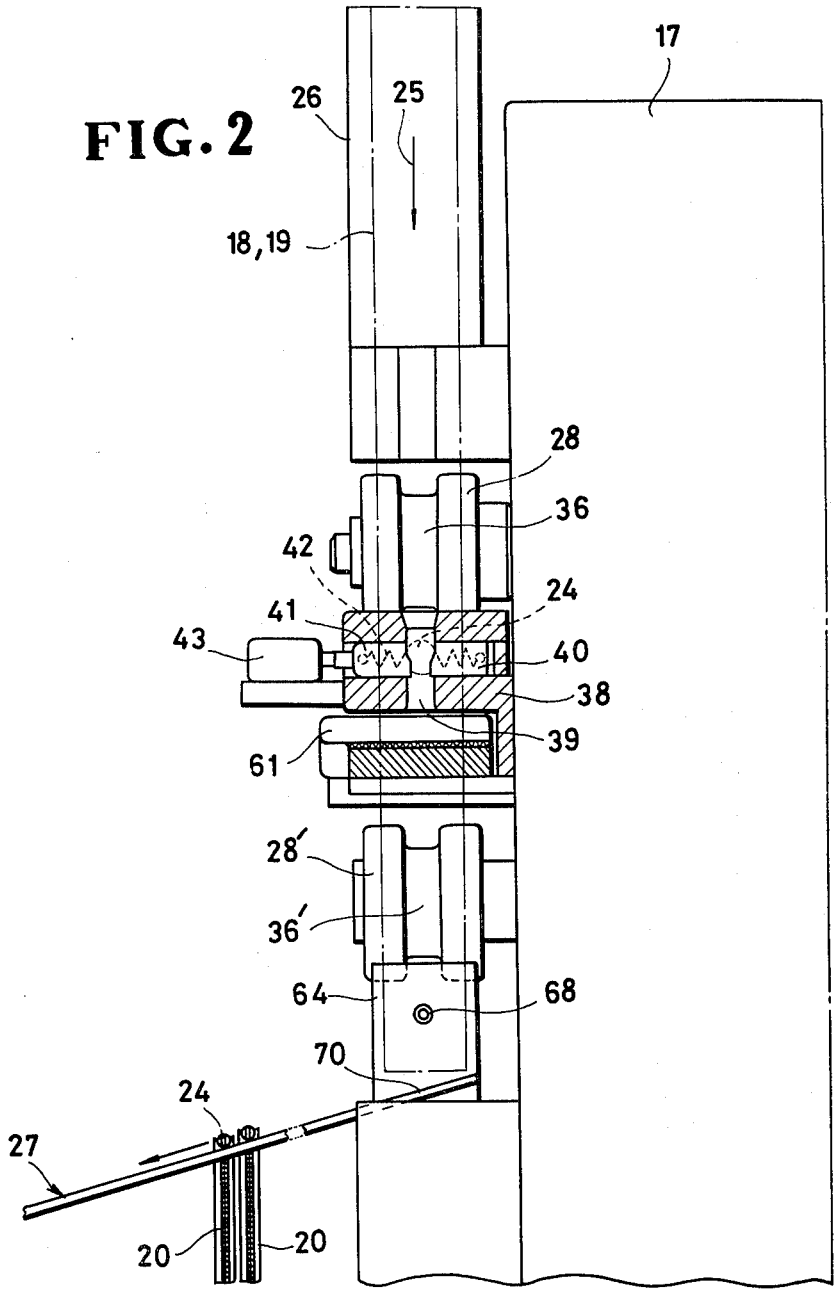
FIG. 2 is a schematic side elevational view, partly in cross section, of the apparatus with parts omitted for clarity.
Figure 3:
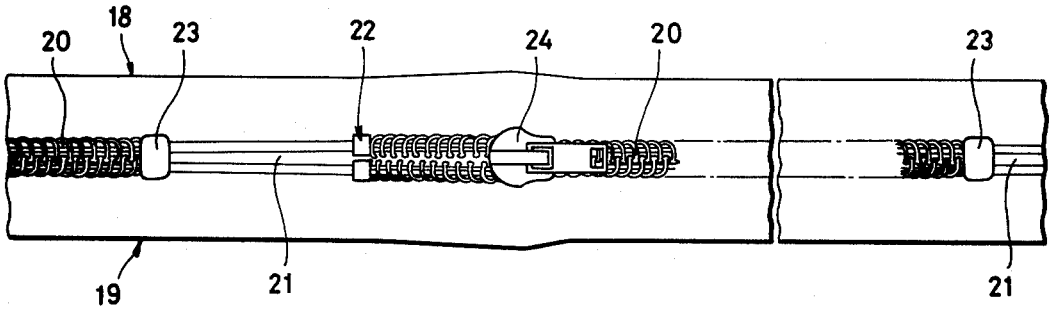
FIG. 3 is an enlarged fragmentary plan view of a pair of slide fastener stringers to be processed by the apparatus.

As shown in FIG. 3, a pair of slide fastener stringers 18, 19 to be finished or processed on the apparatus 10 includes a plurality of longitudinally spaced chains 20 of two rows of partly interengaged coupling elements having a plurality of element-free gaps or spaces 21 disposed between the chains 20. Each of the chains 20 has a top end stop 22 secured at one end and a bottom end stop 23 secured at the other end. A plurality of sliders 24 (only one being illustrated) for taking the rows of coupling elements into and out of mutual engagement is slidably mounted respectively on the coupling element chains 20. As shown in FIGS. 1 and 2, the slide fastener stringers 18, 19 are fed longitudinally downwardly by the feed mechanism 9 in the direction of arrow 25 from a supply chute 26 via the parts 13–16 toward a discharge chute 27.

The upper feed unit 11 includes a drive roller 28 fixed to a shaft 29 rotatably mounted on the base 17 and driven by a drive mechanism (not shown) to rotate clockwise at a first speed, and a pinch roller 30 idly rotatably mounted on one end of a support rod 31 slidably mounted in a housing 32 secured to the base 17. The support rod 31 is connected at the opposite end to a plunger 33 of an actuator or cylinder 34. Thus, the pinch roller 30 is movable toward and away from the drive roller 28 upon energization and de-energization of the cylinder 34. A tension spring 35 acts between the support rod 31 and the housing 32 to normally urge the support rod 31 and hence the pinch roller 30 away from the drive roller 28. Each of the rollers 28, 30 has a circumferential guide groove 36 for the passage therethrough of the sliders 24 on the respective coupling element chains 20.

The lower feed unit 12 has substantially the same construction as that of the upper feed unit 11 and similar parts are indicated by like primed reference numerals. The drive roller 28' of the lower feed unit 12 is driven to rotate clockwise at a second speed higher than the first speed.

The supply chute 26 is mounted on the base 17 upstream of the upper feed unit 11 and has a guide channel 37 for the passage therethrough of the slide fastener stringers 18, 19, the guide channel 37 opening at one end adjacent to the drive and pinch rollers 28, 30. The supply chute 26 also serves as a guard to protect the stringers 18, 19 from possible engagement with the adjacent portion of the chain stopper 14.

The slider holder 13 includes a housing 38 disposed immediately beneath the drive roller 28, the housing having a vertical slot 39 extending in alignment with the circumferential groove 36 in the drive roller 28 for the passage of the sliders 24. A pair of horizontal fingers 40, 41 (FIG. 2) is slidably mounted in the housing 38 and is movable transversely into and out of the slot 39 for releasably gripping therebetween one of the sliders 24. A tension spring 42 acts between the fingers 40, 41 to normally bias them toward each other. A limit switch 43 (FIG. 2) is mounted on the housing 38 adjacent to one of the fingers 41 and is actuated by the finger 41 when the fingers 40, 41 are forced by the sliders 24 to retract away from each other against the bias of the spring 42. The slider holder 13 further includes a stringer support 44 mounted on the base 17 immediately beneath the pinch roller 30 in confronting relation to the housing 38. The stringer support 44 has a vertical recess 45 extending in alignment with the circumferential groove 36 in the pinch roller 30 and opening toward the guide slot 39 in the housing 38, there being a pair of laterally spaced guide surfaces 46 (only one shown in FIG. 1), one on each side of the vertical recess 45, along which the slide fastener stringers 18, 19 are guidedly advanced, respectively.

The chain stopper 14 includes a horizontal switch actuating lever 47 pivotably mounted by a pivot pin 48 on the base 17 and is normally held in the horizontal position of FIG. 1 by a compression spring 49 which acts between a bracket 50 fixed to the base 17 and the actuating lever 47 to urge the latter against a stop bolt 51 extending threadedly through the bracket 50. A vertical stop lever 52 is pivotably supported by a pivot pin 53 on one end of the actuating lever 47 and has a stop lug 54 disposed in the recess 45 and projecting from one or the lower end of the stop lever 52 toward the guide slot 39 in the housing 38, the stop lug 54 having a width insertable in the element-free spaces 21. A tension spring 55 acts between the stop lever 52 and the base 17 to normally urge the opposite or upper end of the stop lever 52 into engagement with a roller 56 idly rotatably supported on a plunger 57 of a fluid-actuated cylinder 58 secured to the base 17. The fluid-actuated cylinder 58 is connected, for energization, in circuit with the limit switch 43 (FIG. 2). The stop lever 52 is pivotably movable, in response to de-energization and energization of the cylinder 58, between the first position shown by solid lines in FIG. 1 where the stop lug 54 is fully received in the vertical recess 45 in the stringer support 44, and the second position shown by the phantom lines in FIG. 1 where the stop lug 54 projects into the guide slot 39 in the housing immediately below the fingers 40, 41 (only one shown in FIG. 1). Through the rolling engagement with the roller 56, the stop lever 52 is also movable up and down by a limited distance with the aid of and against the bias of the compression spring 49. Downward movement of the stop lever 52 causes the actuating lever 47 to pivot in a counterclockwise direction, whereupon a limit switch 59 is actuated by the opposite end of the actuating lever 47. The limit switch 59 is connected, for de-energization, in circuit with the cylinder 58 and with the actuator or cylinder 34' of the lower feed unit 12. The counterclockwise rotation of the actuating lever 47 and hence the downward movement of the stop lever 52 are limited by another stop bolt 60 extending threadedly through the bracket 50 remotely from the pivot pin 48 and the stop bolt 51, with the result that the element-free portions 21 are stopped at a uniform position with respect to the cutter 15.

The cutter 15 comprises a pair of confronting movable and fixed blades 61, 62 between which the slide fastener stringers 18, 19 are movable. The movable blade 61 is driven by a rack-and-pinion mechanism 63 to reciprocably move toward and away from the fixed blade 62 for severing the slide fastener stringers 18, 19 across the element-free space 21. The rack-and-pinion mechanism 63 is driven by a suitable power source (not shown) connected, for energization, in circuit with the limit switch 59.

The end sensor 16 includes a pair of confronting guide stands 64, 65 respectively disposed downstream of the rollers 28', 30' and having a pair of aligned through holes 66, 67, respectively, the slide fastener stringers 18, 19 being movable between the guide stands 64, 65. A photoelectric sensor unit includes a light projector 68 mounted on the guide stand 64 behind the through hole 66 and a photoelectric cell 69 mounted on the guide stand 65 behind the through hole 67, the photoelectric cell 69 being connected, for de-energization, in circuit with the actuator or cylinder 34 and, for energization, in circuit with the actuator or cylinder 34'.

The discharge chute 27 has an upper end portion 70 disposed between the guide stands 64, 65 and a horizontally elongated groove 71 extending throughout the length of the chute 27 for the passage therethrough of the severed individual coupling element chains 20. The upper end portion 70 of the groove 71 has a width narrow enough to prevent the passage therethrough of the sliders 24 on the respective coupling element chains 20.

A time switch 72 is connected in circuit with the limit switch 59 and the actuator or cylinder 34. The time switch 72 is set or started when the limit switch 59 is actuated, and at a predetermined interval of time after its setting, it energizes the cylinder 34 to extend the plunger 33. The time interval is selected such that the slide fastener stringers 18, 19 are fed by the rollers 28, 30 after the cutter 15 has cut off one of the individual length of coupling element chains 20.

In operation, the slide fastener stringers 18, 19 are introduced through the guide channel 37 in the supply chute 26 between the drive and pinch rollers 28, 30 which are at that time separated from each other. Upon energization of the apparatus 10, the drive rollers 28, 28' are driven to rotate in a clockwise direction at the respective predetermined speed, and the cylinder 34 is then energized to move the pinch roller 30 toward the drive roller 28 against the bias of the tension spring 35 as shown, whereby the slide fastener stringers 18, 19 are fed by the upper feed unit 11 downwardly in substantially the vertical direction of the arrow 25 at the first or low speed. During that time, the cylinder 34' of the lower feed unit 12 remains de-energized to keep the pinch roller 30' away from the rotating drive roller 28'.

When the leading ends of the slide fastener stringers 18, 19 pass between the through-holes 66, 67 in the guide stands 64, 65 and block the light beam path from the light projector 68, the photoelectric cell 69 sends electric signals to the cylinders 34, 34' to cause them to reverse their mode of operation. That is, the cylinder 34 is de-energized to retract the pinch roller 30 away from the drive roller 28 and the cylinder 34' is energized to move the pinch roller 30' toward the drive roller 28', whereupon the slide fastener stringers 18, 19 are fed by the lower feed unit 12 longitudinally at the second or higher speed. While the slide fastener stringers 18, 19 are being fed, each slider 24 passes through and is guided by the guide grooves 36 in the rollers 28, 30, enters the guide slot 39 in the slider holder's housing 38, is caught by the fingers 40, 41 and remains gripped therebetween until the slider 24 is engaged by the succeeding one of the top end stops 22. During that time and up to such engagement, the rows of partly interengaged coupling elements of each chain 20 are brought into mutual engagement with each other by the slider 24 in response to the continued feeding of the stringers 18, 19. The further movement of the fastener stringers 18, 19 causes the slider 24 to be forced by the top end stop 22 past the fingers 40, 41 against the force of the tension spring 42. Therefore, the sliders 24 mounted on the coupling element chain 20 become displaced one by one against the top end stops 22 as the slide fastener stringers 18, 19 progress beyond the slider holder 13.

The finger 41 when forced to move away from the mating finger 40 actuates the limit switch 43, whereupon the cylinder 58 is actuated to retract the plunger 57, at which time the stop lever 52 is rotated by the force of the spring 55 in a clockwise direction to cause the stop lug 54 to project through the one of the element-free spaces 21 then adjacent to the top end stop 22 which is engaging the slider 24, and into the guide slot 39 immediately below the fingers 40, 41. As the slide fastener stringers 18, 19 further advance, the bottom end stop 23 of the succeeding chain 20 engages with the stop lug 54 and moves the stop lever 52 downwardly to slide on the roller 56. The downward movement of the stop lever 52 causes the actuating lever 47 to pivot in a counterclockwise direction against the force of the spring 49, thereby actuating the limit switch 59, whereupon the cylinder 34' is de-energized to retract the pinch roller 30' away from the drive roller 28' thereby stopping the feed of the slide fastener stringers 18, 19. At the same time, the limit switch 59 also sets or starts the time switch 72 and actuates the cylinder 58 to extend the plunger 57, thereby rotating the stop lever 52 in a counterclockwise direction to bring the stop lug 54 out of engagement with the bottom end stop 23. The stop lever 52 slides on the roller 56 upwardly as the actuating lever 47 is rotated in a clockwise direction to return to its horizontal position as shown, by the force of the compression spring 49.

Upon de-actuation of the limit switch 59, the movable cutter blade 61 is driven by the rack-and-pinion mechanism 63 to move toward the fixed cutter blade 62 thereby severing the slide fastener stringers 18, 19 across the element-free space 21. The time switch 72, at a predetermined interval of time after its setting, energizes the cylinder 34 to move the pinch roller 30 toward the drive roller 28 thereby again feeding the slide fastener stringers 18, 19 downwardly at the low speed. Thus, the cycle of operation of the apparatus can be repeated automatically until a desired number of severed individual chains 20 are obtained. The severed chains 20 fall one at a time through the guide grooves 36' in the rollers 28', 30' into the groove 71 and, as shown in FIG. 2, hang from the chute's upper end portion 70 by means of the respective sliders 24 which are disposed on the discharge chute 27 astride the groove 71. As shown in FIG. 2, the severed chains 20 (two being illustrated) are discharged in edgewise juxtaposed relation to one another from the apparatus 10 toward the following processing station for packaging or the like as the sliders 24 slide horizontally and downwardly along the discharge chute 27. During that time, the individual chains 20 may be subjected to visual inspection for removing defective chains therefrom.

Thus, the slide fastener stringers are severed into the individual coupling element chains after the latter has been fully closed by the respective sliders as the stringers have been fed by the roller feed unit at the high speed, with the result that the individual coupling element chains can be produced at a rapid rate of production. As the cutter and the slider holder are disposed between the vertically spaced upper and lower roller feed units, the apparatus becomes compact and simple in construction. Furthermore, the guided vertical feed of the stringers to a position of mutual juxtaposition enables convenient subsequent processing, such as inspection, packaging, or the like.

Although various minor modifications may be suggested by those versed in the art, it should be understood that we wish to embody within the scope of the patent warranted hereon, all such embodiments as reasonably and properly come within the scope of our contribution to the art.

We claim as our invention:

1. A method of processing a pair of continuous slide fastener stringers including a plurality of longitudinally spaced chains of partly interengaged coupling elements with a plurality of sliders mounted respectively thereon, and end stops mounted on the opposite ends of each of the chains, there being an element-free space between the successive chains, the method comprising the steps of:

(a) feeding the slide fastener stringers along a path at a first speed;

(b) sensing the arrival at a point of the leading ends of the slide fastener stringers while they are being fed at the first speed;

(c) feeding the slide fastener stringers at a second speed higher than said first speed upon said arrival of the leading ends of the slide fastener stringers;

(d) temporarily holding the slider of one of the moving chains until after the same is engaged by one of the end stops of said one chain, thereby fully closing the chain while the slide fastener stringers are fed at said second speed;

(e) thereafter stopping the feeding of the slide fastener stringers; and (f) severing the slide fastener stringers across the element-free space between said one coupling element chain and the following coupling element chain.

2. A method according to claim 1, said stopping innculding the step of sensing the arrival of the leading end stop of the next succeeding chain.

3. A method according to claim 1, the movement of said stringers in said path being in a substantially vertical and downward direction, and after said severing delivering each severed chain by gravity in a manner wherein the chains become arrested in edgewise juxtaposition.

4. An apparatus for processing a pair of continuous slide fastener stringers including a plurality of longitudinally spaced chains of partly interengaged coupling elements with a plurality of sliders mounted respectively thereon, and end stops mounted on the opposite ends of each of the chains, there being an element-free space between the successive chains, the apparatus comprising:

(a) a power-driven feed mechanism for intermittently feeding the slide fastener stringers both at a first speed and thereafter at a second speed higher than said first speed;

(b) a first sensor disposed downstream of said feed mechanism for detecting the leading end of the slide fastener chain and connected to said feed mechanism to effect the change from said first to said second speed;

(c) a slider holder disposed within said feed mechanism for temporarily arresting the movement of the next slider, said holder yieldably releasing said slider in response to the engagement of the next moving end stop with the slider, the holder thereby effecting the full closing of the coupling elements of the chain while said feed mechanism is operating at said second speed;

(d) a second sensor responsive to said slider holder's release of the slider;

(e) a stopping mechanism under the control of said second sensor and operatively connected to said feed mechanism for interrupting its feeding;

(f) a power-driven cutter operatively controlled by said stopping mechanism for severing the slide fastener stringers across the element-free space; and (g) a time switch actuatable by said stopping mechanism and connected to said feed mechanism for resuming its feeding at said first speed.

5. An apparatus according to claim 4, having a base, said feed mechanism comprising:

(a) a first feed unit supported by said base and operative at said first speed;

(b) a second feed unit supported by said base in alignment with and downstream of said first feed unit and operative at said second speed; and (c) each of said feed units having a pair of normally spaced drive and pinch rollers between which the slide fastener stringers are movable, and an actuator for selectably moving said pair of rollers together for coaction.

6. An apparatus according to claim 5, each of said drive and pinch rollers having a circumferential groove for the passage therethrough of the sliders on the respective coupling element chains.

7. An apparatus according to claim 4, having a base, (a) said feed mechanism being supported on said base and including first and second feed units respectively operative at said first and second speeds, said first feed unit being spaced from said second feed unit;

(b) said slider holder being disposed between said feed units on said base;

(c) said cutter being disposed on said base between said slider holder and said second feed unit;

(d) said first sensor being disposed on said base below said second feed unit; and (e) said stopping mechanism being disposed on said base above said first feed unit and having a lug portion responsive to said chain at a point between said slider holder and said cutter.

8. An apparatus according to claim 4, said first sensor being of the photoelectric type and spanning the path of movement of the slide fastener chains.

9. An apparatus according to claim 4, said second sensor comprising a limit switch disposed on said slider holder and actuatable thereby and connected to said stopping mechanism.

10. An apparatus according to claim 4, said stopping mechanism including:

(a) a first pivotably mounted lever;

(b) a second lever pivotably supported on one end of said first lever and having a stop lug at one end thereof receivable in the element-free space of the chain, said second lever being movable lengthwise for a limited distance in response to engagement between said stop lug and the end stop of the succeeding moving chain whereby said second lever pivots said first lever;

(c) an actuator operatively connected to the opposite end of said second lever for reciprocating said stop lug with respect to the element-free space, said actuator being operatively connected to and controlled by said second sensor; and (d) a further switch operated in response to pivoting of said first lever and operatively connected to said feed mechanism and to said time switch.

11. An apparatus according to claim 10, said slider holder having a recess opening toward the path of movement of the chains, and in which said stop lug is reciprocably disposed.

12. An apparatus according to claim 10, including (a) a roller rotatably supported on said actuator for being reciprocated thereby; and (b) a spring biasing said opposite end of said second lever against said roller; whereby the limited movement of said second lever is enabled.

13. Apparatus according to claim 10, said first lever being engageable with an adjustable stop for limiting the extent of its pivoting, thereby limiting the magnitude of the lengthwise movement of the second lever.

14. An apparatus according to claim 10, including a rack-and-pinion mechanism drivably connected to said cutter and controlled by said further switch.

15. An apparatus according to claim 4, the path of movement of the chains through said cutter being substantially vertical, and being unobstructed therebelow during operation of said cutter, and including a sloping discharge chute having an upper end disposed in registration with the lower end of said path and receptive edgewise of chains movable by gravity from said cutter, said chute having an elongated groove having a width narrower than the thickness of the sliders to be processed, whereby chains being discharged edgewise into said groove will be arrested and supported by coaction between the sliders and the edges of said groove.

16. An apparatus according to claim 4, including a combined guard and supply chute for guiding said stringers to the inlet side of said feed mechanism.

* * * * *